United States Patent [19]

Schmidt

[11] Patent Number: 4,682,578

[45] Date of Patent: Jul. 28, 1987

[54] INFRARED RADIANT HEATER

[75] Inventor: Gerhard Schmidt, Edmonton, Canada

[73] Assignee: Flour City Architectural Metals, Division of E.G. Smith Construction Products, Inc., Pittsburgh, Pa.

[21] Appl. No.: 920,579

[22] Filed: Oct. 17, 1986

Related U.S. Application Data

[63] Continuation of Ser. No. 658,385, Oct. 5, 1984, abandoned, which is a continuation-in-part of Ser. No. 554,207, Nov. 22, 1983, abandoned.

[51] Int. Cl.[4] ..... F24C 3/00

[52] U.S. Cl. ..... 126/91 R; 126/92 B

[58] Field of Search ..... 126/92 R, 92 AC, 92 B, 126/92 C, 91 R

[56] References Cited

U.S. PATENT DOCUMENTS

| | | | |
|---|---|---|---|
| 1,492,135 | 4/1924 | Lewis et al. . | |
| 1,639,114 | 8/1927 | Smith | 126/85 |
| 1,900,570 | 3/1933 | Leiman . | |
| 2,287,246 | 6/1942 | Hess | 431/215 |
| 2,570,554 | 10/1951 | Henwood | 126/85 B |
| 2,935,127 | 5/1960 | Stalego | 158/99 |
| 3,115,924 | 12/1963 | Massier | 158/73 |
| 3,162,238 | 12/1964 | Claywell et al. | 158/99 |
| 3,262,484 | 7/1966 | Hess | 158/7.6 |
| 3,279,455 | 10/1966 | Corey | 431/19 |
| 3,302,683 | 2/1967 | Kemp | 158/4.5 |
| 3,703,895 | 11/1972 | Wiberg | 126/85 B |
| 3,763,847 | 10/1973 | Guzdar | 126/92 B |
| 3,827,424 | 8/1974 | Brola | 126/92 B |
| 3,946,719 | 3/1976 | Bard et al. | 126/91 A |
| 4,140,482 | 2/1979 | Simon | 432/209 |
| 4,200,085 | 4/1980 | Buchl | 126/9 B |
| 4,310,303 | 1/1982 | Collier | 432/209 |
| 4,354,479 | 10/1982 | Haruhara | 126/92 |
| 4,364,724 | 12/1982 | Alpkvist | 431/11 |
| 4,488,865 | 12/1984 | Davis | 431/1 |

FOREIGN PATENT DOCUMENTS

| | | |
|---|---|---|
| 1401756 | 4/1969 | Fed. Rep. of Germany . |
| 2358187 | 5/1975 | Fed. Rep. of Germany . |
| 836709 | 4/1938 | France . |
| 7506818 | 12/1975 | Netherlands . |
| 207242 | 11/1923 | United Kingdom . |
| 2062209 | 10/1979 | United Kingdom . |

*Primary Examiner*—Carroll B. Dority, Jr.

*Attorney, Agent, or Firm*—Webb, Burden, Robinson & Webb

[57] ABSTRACT

An infrared radiant heater comprising a burner for moving combustion supporting air over an exhaust flue gas transfer pipe toward the fuel nozzle which is spaced from the blower. A first cone of high temperature resistant metal positioned at said nozzle to receive heat from the combustion of the fuel and an interior cone shaped surface to maintain heat against said first cone and direct the exhaust gases to said flue gas transfer pipe.

23 Claims, 7 Drawing Figures

INFRARED RADIANT HEATER

RELATED APLICATION

This application is a continuation of application Ser. No. 658,385, filed Oct. 5, 1984, and now abandoned which is a continuation-in-part of application Ser. No. 554,207, filed Nov. 22, 1983, now abandoned.

BACKGROUND OF THE INVENTION

1. Field of the Invention

This invention relates to infrared radiant heaters which have a large heat radiating surface heated to a temperature between 1100 to 1245 degrees Celsius and particularly to an improved infrared radiant heater wherein the pressurized air for combustion is preheated by the flue gas, the fuel is injected by a pressure jet, and combustion heat is directed along the radiation member as it is exhausted. The heater is mounted on a transport and its position is adjustable to direct the radiant energy where desired.

2. Description of the Prior Art

Infrared heaters are known which have a surface generating radiation at a temperature of about 480 degrees Celsius, but, infrared radiant heaters which are in fact artificial suns designed to produce and transmit infrared radiant energy over large distances, are not known.

In producing radiant heat waves in the infrared range the thermal energy is produced by converting the energy of fuel oil, gas or propane into heat by the process of combustion. The infrared radiant heat is absorbed by people and objects over wide areas and at large distances in the path of the infrared rays. The wave lengths of the infrared rays are spread over a broad spectrum which corresponds with the maximum absorption level of many common materials.

SUMMARY OF THE INVENTION

The infrared radiant heater of the present invention comprises a specially designed heat exchanger wherein the flue gas transfer or exhaust pipe preheats the combustion air forced by a blower toward a fuel nozzle and affords combustion to heat a geometric conical surface designed to present a large incandescent surface area which is also resistant to thermal shock. The material utilized to provide the heat radiating surface is a low carbon nickel-chromium alloy which has a long working life. This surface is heated to a temperature of between 1100 and 1245 degrees Celsius by the combustion of fuel oil, kerosene, propane or natural gas. The high intensity combustion is produced in the combustion chamber by a fully automatic pressure jet industrial burner which has an automatic ignition and continuous flame surveillance. The blower air provided for combustion of the fuel jet from the nozzle is preheated from the heated flue gas transfer pipe to readily increase the efficiency of the combustion process. The combustion takes place within an enclosed chamber which reduces the condensation problem encountered with other burner systems. An inner conical wall directs the heat along the interior surface of the heat generating concial surface to flue gas discharge ports leading to the heat exchanger. The air path of the flue gas maintains the heat in the burner and heats the heat generating surface.

The infrared radiation from the conical radiating surface is reflected off a polished reflector surrounding the cone. The reflector is disposed off the axis of the cone at an angle of between 30 and 50 degrees. The reflector helps to direct the radiant energy where desired.

The heater is mounted on a transport and pivots in relation to the transport to direct the heat where desired. The burner can thus be used to thaw frozen ground prior to digging and protects orchards, among many other uses.

BRIEF DESCRIPTION OF THE DRAWINGS

The present invention will be further described with reference to the accompanying drawing wherein.

DESCRIPTION OF THE PREFERRED EMBODIMENTS

Figure 1:
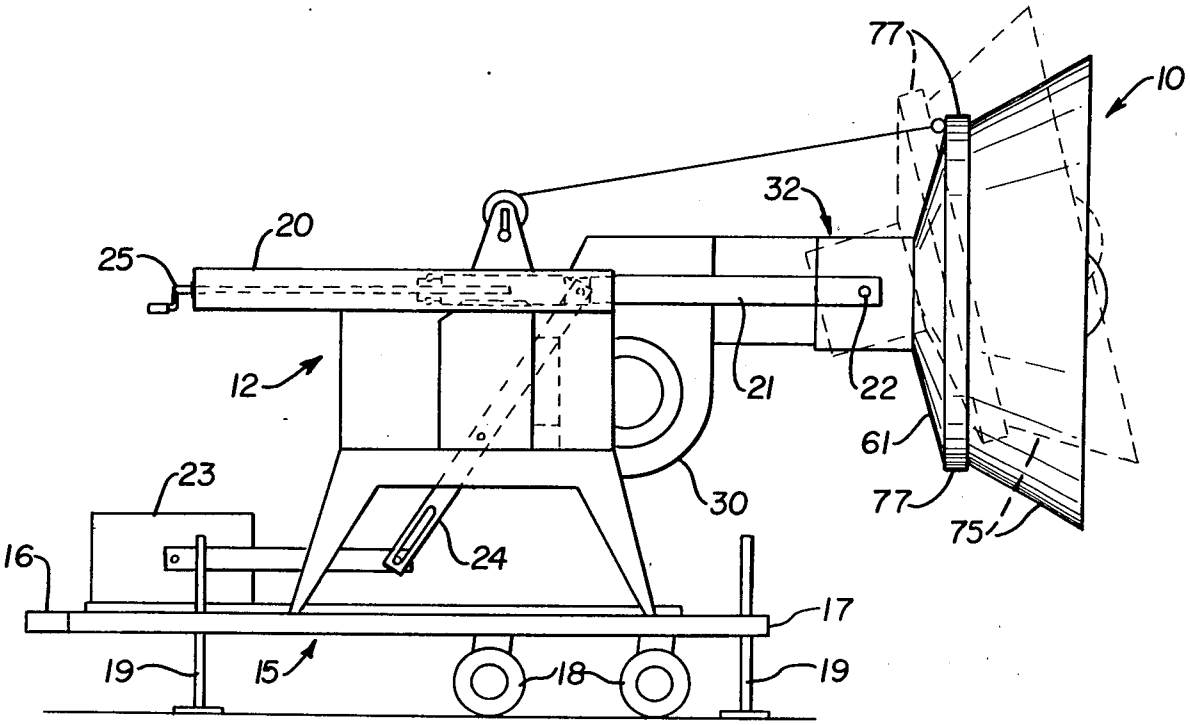
FIG. 1 is a side elevational view of the infrared radiant burner mounted on a trailer.

Referring now to FIG. 1, the radiant energy heater generally designated by the reference number 10 is mounted on a frame 12 supported on a trailer 15. The trailer 15 comprises a frame 17 having a hitch 16, transport wheels 18 supporting the trailer, and adjustable jacks 19 to support and stabilize the trailer in a desired fixed location. Mounted on the trailer 15 is the frame 12 which comprises a pair of spaced-apart tracks 20 which permit a pair of support bars 21 to slide with respect thereto. The support bars 21 are spaced transversely and disposed on either side of and connected to the heater 10. Each support bar 21 is moved relative to the frame 12 or tracks 20 to position the burner at some point between the tracks or position the burner beyond the tracks where the infrared radiating head of the heater 10 may be adjusted about a horizontal axis 22 to direct the energy from the heater in different vertically oriented directions. A counterweight 23 is slidably mounted in relationship to the frame 12 and is positioned adjacent the trailer 15. The counterweight 23 is movable in response to the pivotal movement of a link 24 such that as the heater is moved to a position extending beyond the rear of the trailer 15, the counterweight is moved forwardly on the trailer to avoid tipping of the trailer. Movement of the support bars 21 with respect to the frame 12 is afforded by means of a drive mechanism such as a crank 25 with a screw-follower drive connected between the frame 12 and the support bars 21. Electric motor driven drive systems could be employed to afford remote positioning of the heater. Alternatively, hydraulic cylinders can be used to move the burner and to pivot the burner.

The heater 10 comprises a blower 30 which is positioned to direct air under pressure into a combustion chamber, generally designated 31, after passing through a heat exchanger 32 which will hereinafter be defined, and the combustible fuel is directed under pressure into a pipe 33 leading to a nozzle 35 in the combustion chamber 31. The pipe 33 is positioned within a shroud or protective insulating sleeve 36 to carry the combustible fuel to the nozzle 35. Air from the large blower 30 is directed about the shroud 36 and through the heat exchanger 32 and about the flue gas heat transfer pipe 70. The combustion air is directed through openings 37 in a flame funnel 38 at the nozzle 35 to afford combustion of the fuel and exhaust the combustion energy from the combustion chamber and remove the flue or exhaust gases. An ignitor 39 is positioned adjacent the nozzle 35.

The flame within the combustion chamber is monitored by a photo resistant cell which monitors the burner to lock out safely any further combustion in the event of flame failure. This control meets the latest standards and is used extensively in industrial applications.

Combustion of the fuel from the nozzle 35 is directed toward and heats a cone-shaped heat absorbing and radiating surface 45 which is preferably made of a heat-resistant material and is preferably formed from a low carbon nickel-chromium alloy. An example is material available from Huntington Alloys, Inc., Huntington, W. Va. 25720, under the number 166B-166-167-168, and sold under the brand name "Inconel". Such material is resistant to high heat above 1300 degrees Celsius.

Figure 3:
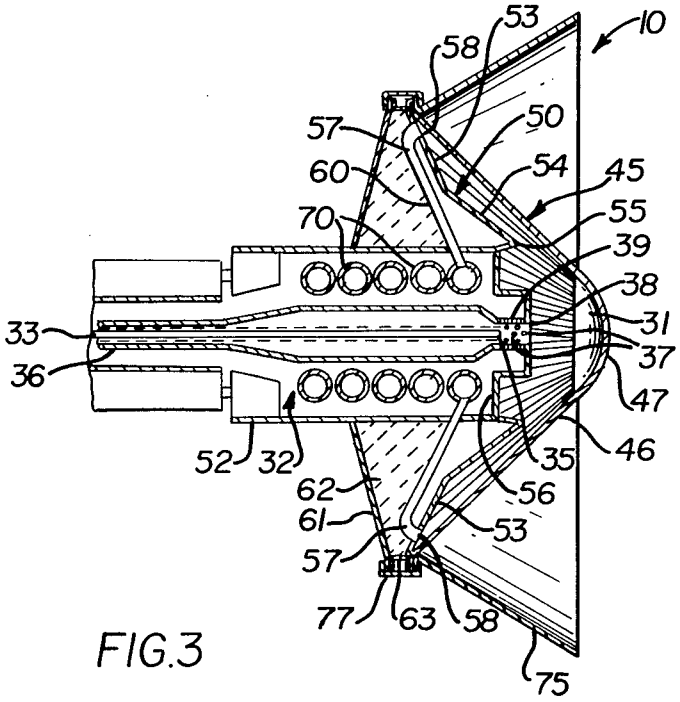
FIG. 3 is a vertical sectional view through the combustion chamber of the heater.
Figure 2:
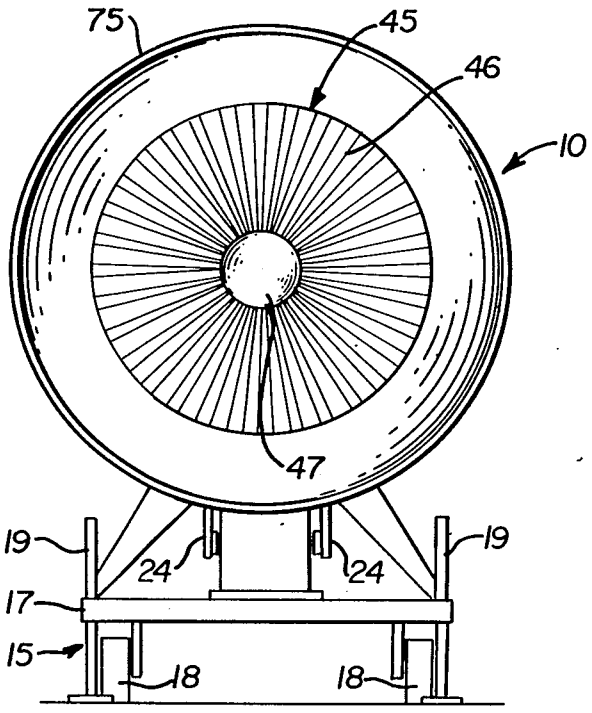
FIG. 2 is a front elevational view of the infrared radiant burner.
Figure 4:
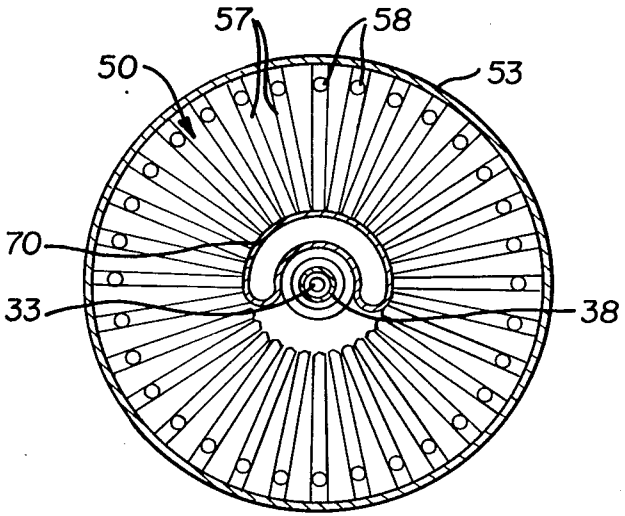
FIG. 4 is a vertical cross-sectional view of the burner with the cone removed.
Figure 5:
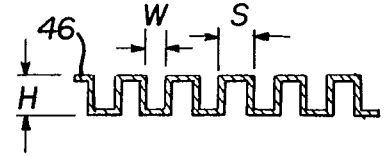
FIG. 5 is a sectional view showing the edge of the heat radiating cone as shown in FIG. 2.

The cone 45, as illustrated in FIGS. 3 and 5, is specially designed so as to present a large incandescent surface area and resist thermal shock. The cone 45 has a fluted or corrugated surface with the corrugations 46 being generally triangular in front elevation, and the ridges and grooves thereof extend from the conical nose 47 of the cone 45 to the peripheral edges of the face thereof. These corrugations serve to both enlarge and strengthen the surface of the cone and at the same time reduce the effect of the flame heat on the cone. As an example, the cone 45 has a diameter of 170 cm and from the truncated hemispherial cone nose 47 the troughs are 2 cm by 2 cm and are 7 cm deep (H) by 6 cm wide (W) and are spaced 6 cm (S) at the edge, see FIG. 5. The inner surface of the cone 45 is equipped with a fireproof coating, for example a pliable alu-fibrous silicic acid membrane.

The cone 45 is mounted coaxially with the shroud 36, and the interior of the cone 45 defines one wall of the combustion chamber 31 placed about the fuel nozzle 35 which is positioned between the outer cone 45 and an inner heat distributing cone, generally designated 50, which is supported about a jacket 52. The inner cone 50 is formed with an outer conical member 53, which is joined at its periphery to the periphery of the cone 45, and an inner conical member 54 which is joined to a circular end wall of the jacket 52 by an inverted coaxial third conical wall 55 and ring or cap 56. The members 53, 54, 56 and 38 are all formed of the same alloy as the cone 45. Behind the members 53 and 54 are positioned a plurality of tubes 57 which are positioned to connect with a series of exhaust ports 58 and extend radially inward to the heat exchanger 32. A foil 60 forms a barrier between the tubes 57 and an outer wall 61, defining therebetween the support structure which is filled with a ceramic wool insulation 62. The outer wall 61 is bolted to the jacket 52 and extends radially to the periphery where it is joined to a ring 63, L-shaped in cross-section.

The cone 45 and members 53, 54 and 56 define the combustion chamber and exhaust gas manifold which direct the hot combustion gases along the face of the cone 45, through a venturi like space over the edge of member 54 and in a turbulent manner toward the ports 58. From the ports the exhaust or flue gases pass through the tubes 57 to a helical exhaust pipe 70 which is inside the jacket 52 and surrounds the shroud 36. The pipe 70 is disposed in the path of the combustion air driven by the blower 30 into the combustion chamber. This helical exhaust or flue gas heat transfer pipe 70 of the heat exchanger 32 defines an elongate path for the flue gas and exposes a large surface area of the pipe 70 to the combustion air to preheat the combustion air such that when it reaches the combustion chamber and is directed by the cap 56 toward the openings 37 in the flame funnel and at the fuel discharged by the nozzle 35 from which the combustion fuel is discharged into the combustion chamber, the combustion air is at a temperature to nearly flash the pressurized fuel discharged from the nozzle 35. The fuel, in the case of fuel oil, is discharged at a nozzle pressure of 7 to 12 millibars.

The exhaust or flue gases are directed through the pipe 70 to a chimney at its end from which they are directed into the atmosphere or through a suitable high temperature flexible duct attached to the chimney to pipe them outside.

Surrounding the outer periphery of the heated cone 45 is a stainless steel reflector 75 having an inner surface which is polished to direct the radiation from the cone 45. This cone-shaped reflector 75 concentrates the rays from the cone 45 and the reflective surface is disposed at an angle of 30 to 50 degrees to the axis of the heater. A stainless steel ring or cap 77 surrounds the periphery of the cone 45, where it is joined to the cone 53, the wall 61, ring 63, and reflector 75.

Figure 6:
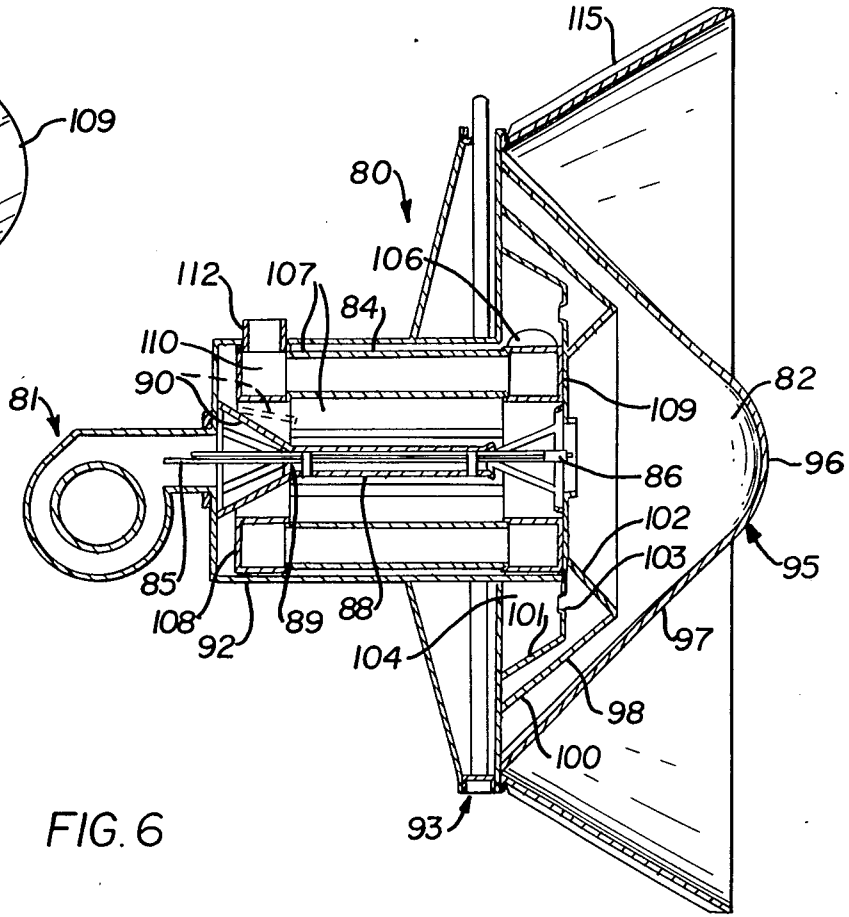
FIG. 6 is a vertical sectional view showing a further embodiment with a modified flue gas pipe and flue gas path to heat combustion air.
Figure 7:
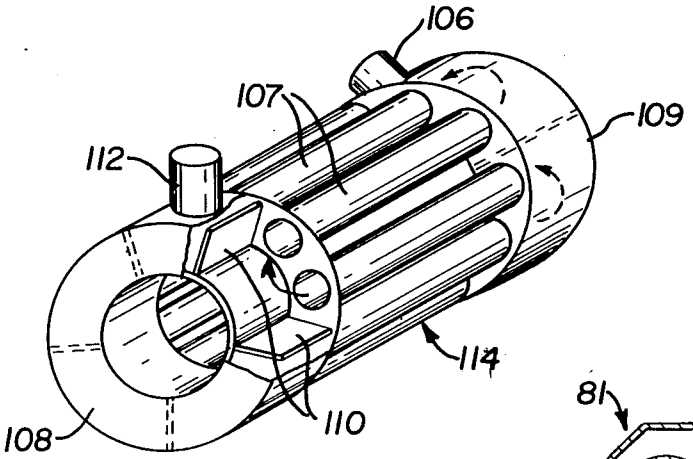
FIG. 7 is a detail perspective view of the flue gas pipe of the embodiment of FIG. 6.

In a further embodiment of the present invention illustrated in FIGS. 6 and 7, the heater 80 comprises a blower 81 which is positioned to force air through a heat exchanger 84 and into a combustion chamber, generally designated 82. The combustible fuel is directed under pressure through a pipe 85 leading to a nozzle 86, which nozzle is positioned adjacent the igniter and disposed to present a jet of fuel into the combustion chamber.

The fuel line 85 is positioned within a shroud 88 which supports the fuel line and igniter wires and is formed at the end adjacent the blower with a bell-shaped end 89 which receives the air from the blower 81. Four hinged doors 90 are positioned about the bell-shaped end 89 of the shroud 88. The doors 90 are hinged for movement from the closed position, as indicated in solid lines in FIG. 6, to the open position, as indicated in the dotted lines. Springs, e.g. torsion springs at the hinge, urge the doors 90 to the normally closed position such that in the event of any backfire or blowback of the air as a result of the ignition, the doors 90 close about the bell-shaped end 89 to protect the blower. Normally the blower drives sufficient air at sufficient pressure to force the doors 90 to an open position against the force of the torsion springs at the hinges, allowing air into the heat exchanger 84.

The heat exchanger 84 comprises a large tubular housing 92, illustrated as cylindrical, which is supported on the frame 93 supporting the heat-generating conical member 95. The air is allowed to fill the chamber of the housing 92 and circulate about the flue gas transverse pipe. The air is directed then through openings in a second conical end at the opposite end of the shroud 88, and the air is directed toward the nozzle 86, affording combustion of the fuel within the combustion chamber 82. The blower air and the combustion of the fuel forces the combustion and the exhaust gases against the inner surface of the heat-generating conical member 95 which is constructed and is similar in size and appearance to the cone 45. The conical member 95 is provided with the circular cone 96 and fluted outer surface 97 with corrugations, as shown in FIG. 5, which distribute the exhaust gas and directs it to exhaust openings. The exhaust gases are retained against the inner surface of the member 95 until they are driven, by additional air and combustion gases, to a position between an inner conical wall 98 and the interior surface of the cone 95. The conical wall 98 is provided with a plurality of circumferentially spaced openings 100, which allow the flue gas to enter a further interior chamber defined between the wall 98 of the interior cone and a further wall member 101 until the air reaches the top of the truncated cone formed by the wall 98 and a conical wall 102. Here the exhaust or flue gases pass through openings 103 and enter a flue gas passageway or plenum 104 surrounding an end of the housing 92 of the heat exchanger 84. The flue gases are then allowed to enter the opening of a pipe 106 leading into the flue gas heat transfer pipe disposed within the housing 92 of the heat exchanger 84. The flue gases which enter the pipe 106 are directed in an elongate path which is serpentine and circumferential about the shroud 88 to correspond to the helical path of the heat transfer flue gas pipe 70 to expose a large surface of the pipe to the combustion air, which circulated air is heated by the exhaust gas until substantially all the heat is removed and transferred to the combustion air. The flue gas heat transfer pipe comprises a plurality of parallel pipes 107 joined to annular pipes 108 and 109 defining a series of manifolds, separated by baffels 110, connecting the ends of two adjacent pipes 107, serially about their ends to direct the exhaust gas back and forth through adjacent pipes 107 until the gas entering the pipe 106 is exhausted through a pipe 112. Gas entering the pipe 106 is directed from a manifold in the annular pipe 109 into a first pipe 107 of the flue gas transfer pipe to a second manifold in annular pipe 108. There the gas is directed back along a parallel flue gas transfer pipe 107 toward another manifold in the annular pipe 109 which then permits the air to communicate with a third pipe 107, directing it back to a second manifold in the annular pipe 108, directing the air back again in another transfer pipe 107 until the air finally travels back and forth between the manifolds in the annular pipes 108 and 109 to exit the pipe 112. In its travel around this serpentine path the exhaust gas serves to preheat the incoming combustion air driven by a blower 81 into the housing 92 surrounding the flue gas transfer pipe generally designated 114 and illustrated in perspective detail in FIG. 7.

A reflector 115 surrounds the periphery of the cone 95 in a manner similar to that of the reflector 75 to direct the radiant energy toward the object to be heated.

The heat from the combustion chamber readily brings the outer cone to a temperature of between 1100 and 1245 degrees Celsius, radiating therefrom infrared radiant energy of a wave length readily absorbable by most common materials to warm the same and effectively provide the heat desired. To produce the radiant energy requires approximately 1.2 million BTU per hour from the burner. In most working environments 28 to 35 seconds of fuel oil produces essentially immediate heat. Diesel or propane fuel can also be used in the heater. The rate of consumption of kerosene would be 7 to 7¼ gallons per hour (approximately 28.7 liters). The blower moves air through the burner at 600 cubic feet per minute. The infrared radiant heater of the present invention is very useful as a substitute for traditional heating methods in large open areas such as warehouses, stations, sports stadiums and the like. The infrared heaters can be of substantial value in the construction field where it is desired to remove the frost from the gound so that the ground may be excavated. The heaters also may serve as suitable apparatus to keep frost from outside pumping stations as well as in orchards or vineyards. The heat energy can be directed a distance of about 165 feet. The efficiency depends on such factors as moisture content of the air and the air pressure.

Having thus described the present invention it will be appreciated that certain changes may be made without departing from the spirit or scope of the invention as defined in the appended claims.

I claim:

1. An infrared radiant heating apparatus for use in heating articles rapidly and efficiently by infrared radiation absorption, said apparatus comprising a support frame, a heat absorbing and radiating heater mounted on said support frame, said heater including an inner heat cone and an outer heat cone spaced apart from each other and joined together along their outer peripheries to define a combustion chamber therebetween, said outer heat cone having an exposed convex conical surface and being formed of a heat absorbing and radiating material, said heater further including a fuel pipe extending to a nozzle which extends through said inner heat cone and opens into said combustion chamber, a shroud surrounding said fuel pipe, a cylindrical jacket surrounding and spaced apart from said shroud and joined at one end to said inner heat cone, a helical exhaust pipe disposed within said jacket and surrounding said shroud, said inner cone having a plurality of exhaust ports therethrough along its outer periphery, with each of said exhaust ports connected to said helical exhaust pipe by a tubular pipe, means for channeling combustion and exhaust gases from said combustion chamber along the inner surface of said outer cone and to said exhaust ports, and burner means including means for supplying fuel to said fuel pipe and means for supplying air through the space between said jacket and said shroud and to said nozzle, whereby hot gases pass through said tubular pipes and through said helical exhaust pipe and the incoming combustion air passes over said helical exhaust pipe and is preheated thereby from the transfer of heat.

2. The apparatus of claim 1 wherein said outer heat cone has a generally rounded apex portion and radially outwardly extended fluted areas for increasing the surface area of said outer heat cone between said rounded apex and said outer periphery, said fluted areas defining said means for channeling gases along the inner surface of said outer heat cone to said exhaust ports.

3. The apparatus of claim 2 wherein each fluted area has an exhaust port adjacent thereto.

4. The apparatus of claim 1 wherein said frame is mounted on transport means for moving said apparatus to a site where the heater is to be used.

5. The apparatus of claim 4 wherein said frame means is pivotally mounted with respect to said transport means whereby the axis of said outer heat cone can be directed at varying angles to the horizontal.

6. The apparatus of claim 4 wherein said transport means comprises a trailer having wheels and a hitch, a frame supporting said support frame for pivotal movement in relationship to said trailer, and means for pivoting said support frame on said frame to adjust the axis of said outer heat cone.

7. The apparatus of claim 1 further including a reflector surrounding said heater and directing the radiation outwardly from said outer heat cone.

8. The apparatus of claim 1 wherein said outer heat cone is formed of a low carbon nickel-chromium alloy resistant to heat above 1300 degrees Celsius.

9. The apparatus of claim 1 wherein said outer heat cone has a diameter of 170 centimeters at its outer periphery and has triangular shaped troughs formed in its surface thereof and extending from a hemispherical apex of the cone to its outer periphery to define said means for channeling said combustion and exhaust gases.

10. The apparatus of claim 1 further including spring biased and pivoted closures for restricting the movement of air from the combustion chamber backwards through the space between said shroud and said jacket.

11. An infrared radiant heating apparatus for use in heating articles rapidly and efficiently by infrared radiation absorption, said apparatus comprising a support frame, a heat absorbing and radiating heater mounted on said support frame, said heater including an inner heat cone and an outer heat cone spaced apart from each other and joined together along their outer peripheries to define a combustion chamber therebetween, said outer heat cone having an exposed convex conical surface and being formed of a heat absorbing and radiating material, said heater further including a fuel pipe extending to a nozzle which extends through said inner heat cone and opens into said combustion chamber, a shroud surrounding said fuel pipe, a cylindrical housing surrounding and spaced apart from said shroud and joined at one end to said inner heat cone, a pair of spaced annular pipes surrounding said shroud and disposed within said housing, a plurality of substantially parallel flue gas pipes which surround said fuel pipe and extend between said annular pipes and are joined thereto in fluid communication, said heater further including an interior wall disposed behind said inner cone and forming an interior chamber therebetween, said inner cone having a plurality of exhaust ports therethrough along its outer periphery and extending into said interior chamber, said interior wall having a plurality of openings therethrough which extend into a plenum surrounding said housing, an exhaust pipe extending between said plenum and one of said annular pipes, and an outer pipe extending from the other annular pipe, each of said annular pipes including a plurality of baffles which connect the ends of two adjacent flue gas pipes, with the baffles in one annular pipe staggered from the baffles in the other annular pipe, means for channeling combustion and exhaust gases from said combustion chamber along the inner surface of said outer cone and to said exhaust ports, and burner means including means for supplying fuel to said fuel pipe and means for supplying air through the space between said shroud and said housing and to said nozzle, whereby hot gases pass through said exhaust pipe, interior chamber, and plenum to one of said annular pipes and travels back and forth through adjacent flue gas pipes between the annular pipes until reaching the outer pipe, and whereby the incoming combustion air passes over said flue gas pipes and annular pipes and is preheated thereby from the transfer of heat.

12. The apparatus of claim 11 wherein said outer heat cone has a generally rounded apex portion and radially outwardly extended fluted areas for increasing the surface area of said outer heat cone between said rounded apex and said outer periphery, said fluted areas defining said means for channeling gases along the inner surface of said outer heat cone to said exhaust ports.

13. The apparatus of claim 12 wherein each fluted area has an exhaust port adjacent thereto.

14. The apparatus of claim 11 wherein said frame is mounted on transport means for moving said apparatus to a site where the heater is to be used.

15. The apparatus of claim 14 wherein said frame means is pivotally mounted with respect to said transport means whereby the axis of said outer heat cone can be directed at varying angles to the horizontal.

16. The apparatus of claim 14 wherein said transport means comprises a trailer having wheels and a hitch, a frame supporting said support frame for pivotal movement in relationship to said trailer, and means for pivoting said support frame on said frame to adjust to axis of said outer heat cone.

17. The apparatus of claim 11 further including a reflector surrounding said heater and directing the radiation outwardly from said outer heat cone.

18. The apparatus of claim 11 wherein said outer heat cone is formed of a low carbon nickel-chromium alloy resistant to heat above 1300 degrees Celsius.

19. The apparatus of claim 11 wherein said outer heat cone has a diameter of 170 centimeters at its outer periphery and has triangular shaped troughs formed in its surface thereof and extending from a hemispherical apex of the cone to its outer periphery to define said means for channeling said combustion and exhaust gases.

20. The apparatus of claim 11 further including spring biased and pivoted closures for restricting the movement of air from the combustion chamber backwards through the space between said shroud and said housing.

21. An infrared radiant heater for use in heating articles rapidly and efficiently and at distances, said heater comprising a combustion chamber defined between the interior surface of a heat absorbing and radiating cone and means defining a zone for mixing combustion air and fuel for burning and for holding combustion gases near said cone, means defining a series of openings at the periphery of said cone for receiving exhaust gases and directing the gases radially inwardly, an exhaust heat producing exchanger comprising a helical heat exchange pipe disposed in the path of said combustion air for collecting and carrying away the exhast gas, and burner means comprising a nozzle for discharging pressurized fuel and blower means for forcing combustion air over siad heat exchange pipe and toward said nozzle for heating said cone.

22. An infrared radiant heater for use in heating articles rapidly and efficiently by radiation absorption, said heater comprising a support frame, a heat absorbing and radiating cone of metallic material resistant to heat mounted on said support frame, wall means defining a combustion chamber adjacent the inner surface of said cone affording the burning of combustion generating materials, means for channeling combustion and exhaust gases over the interior surface of said cone, means defining a flue gas heat transfer pipe for receiving the exhaust gases from said cone, and burner means including means supplying fuel to said combustion chamber and blower means for supplying air under pressure to said combustion chamber, said air being preheated by said means defining the flue gas heat transfer pipe being disposed between said blower and said combustion chamber, wherein said means defining a flue gas heat transfer pipe is disposed in a tubular chamber disposed between said blower means and said combustion chamber for receiving air from said blower means, said means defining said flue gas heat transfer pipe defining an extended path for exposing an enlarged surface area of said flue gas transfer pipe to the blower air being forced through said tubular chamber toward said combustion chamber for heating said air and aiding in the combustion and wherein said path is a helical path surrounding a fuel supply tube disposed generally axially to said cone for delivering fuel to the combustion chamber.

23. An infrared radiant heater for use in heating articles rapidly and efficiently by radiation absorption, said heater comprising a support frame, a heat absorbing and radiating cone of metallic material resistant to heat mounted on said support frame, wall means defining a combustion chamber adjacent the inner surface of said cone affording the burning of combustion generating materials, means for channeling combustion and exhaust gases over the interior surface to said cone, means defining a flue gas heat transfer pipe for receiving the exhaust gases from said cone, and burner means including means supplying fuel to said combustion chamber and blower means for supplying air under pressure to said combustion chamber, said air being preheated by said means defining the flue gas heat transfer pipe being disposed between said blower and said combustion chamber, wherein said means defining a flue gas heat transfer pipe is disposed in a tubular chamber disposed between said blower means and said combustion chamber for receiving air from said blower means, said means defining said flue gas heat transfer pipe defining an extended path for exposing an enlarged surface area of said flue gas transfer pipe to the blower air being forced through said tubular chamber toward said combustion chamber for heating said air and aiding in the combustion, wherein the flue gas heat transfer pipe comprises a pipe disposed in said tubular chamber for directing the exhaust gas in a serpentine manner about a fuel supply tube transferring the fuel to the combustion chamber, and wherein the tube directing the fuel to the combustion chamber is disposed in a shroud having at one end thereof adjacent said blower means, spring biased closures for restricting the movement of air from the tubular chamber toward the blower means.

* * * * *